United States Patent [19]
Roberts

[11] 4,381,212
[45] Apr. 26, 1983

[54] FINGERLESS SINGLE FACER

[75] Inventor: Webster C. Roberts, Cherry Hill, N.J.

[73] Assignee: Molins Machine Company, Inc., Cherry Hill, N.J.

[21] Appl. No.: 193,515

[22] Filed: Oct. 2, 1980

Related U.S. Application Data

[63] Continuation of Ser. No. 122,924, Feb. 20, 1980, abandoned.

[51] Int. Cl.³ ..... B31F 1/28
[52] U.S. Cl. ..... 156/473; 29/121.5; 29/121.6; 29/125; 29/130; 156/497; 226/85; 271/112; 271/276; 425/369; 425/388; 425/396
[58] Field of Search ..... 156/471–473, 156/497, 462; 425/365, 388, 396; 29/121.5, 121.6, 125, 130; 226/95; 271/94, 112, 196, 276

[56] References Cited

U.S. PATENT DOCUMENTS

| | | | |
|---|---|---|---|
| 1,264,506 | 4/1918 | Hahn | 156/473 |
| 1,981,338 | 11/1934 | Swift | 156/473 |
| 2,068,155 | 1/1937 | Swift | 156/473 |
| 4,177,102 | 12/1979 | Tokuno | 156/472 |
| 4,245,975 | 1/1981 | Hattori | 425/369 |
| 4,251,313 | 2/1981 | Abe | 156/472 |
| 4,270,969 | 6/1981 | Kelley | 156/473 |
| 4,310,375 | 1/1982 | Seki | 425/369 |
| 4,348,250 | 9/1982 | Bromley | 156/473 |

*Primary Examiner*—Jerome W. Massie
*Attorney, Agent, or Firm*—Seidel, Gonda, Goldhammer & Panitch

[57] ABSTRACT

A single facer machine for making a corrugated web is provided with a vacuum means for retaining a corrugated medium on one of the corrugating rolls. Said one corrugating roll has a core through which a heated fluid may flow. The core is surrounded by a sleeve which contains peripheral longitudinally extending flutes and valleys meshed with corresponding flutes and valleys on the other corrugating roll. A suction housing is juxtaposed to the outer periphery of said sleeve.

11 Claims, 5 Drawing Figures

FIG. 1
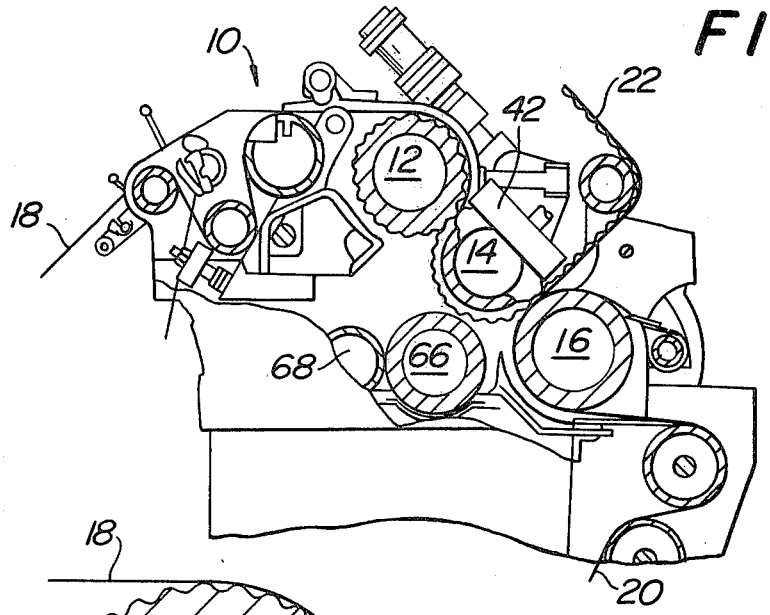
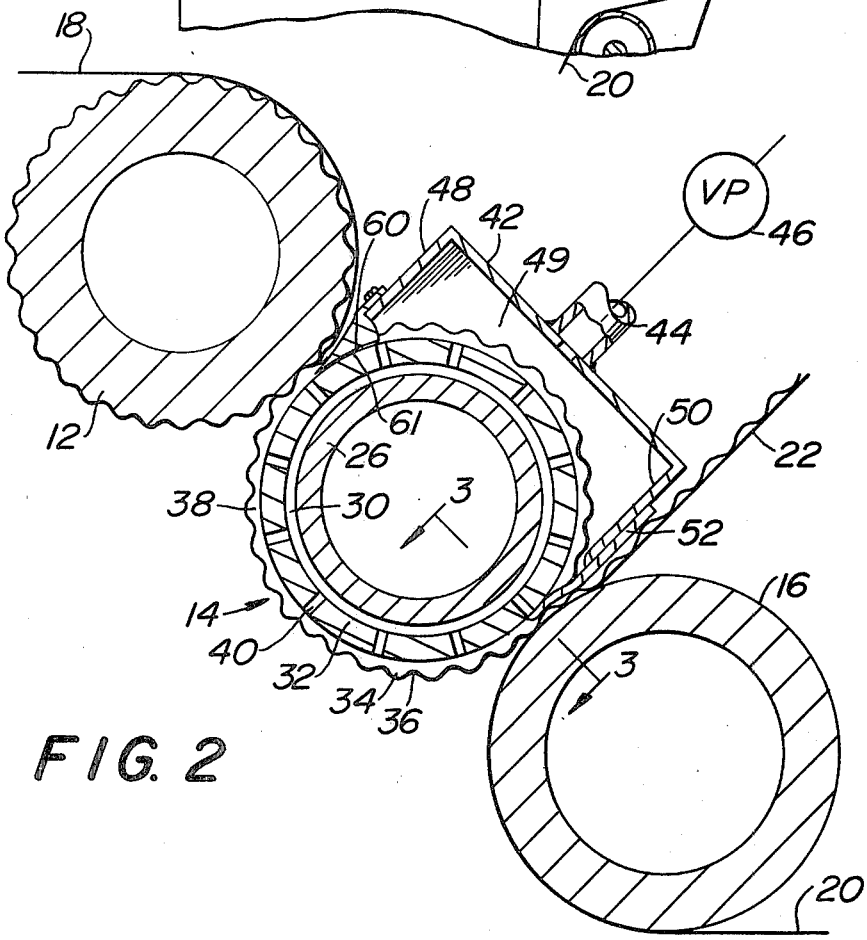
FIG. 2

FINGERLESS SINGLE FACER

This is a continuation of application Ser. No. 122,924, filed Feb. 20, 1980, now abandoned.

BACKGROUND

Single facer machines for making corrugated paperboard webs are well-known to those skilled in the art. In a typical modern single facer machine, a web of medium passes between meshing corrugating rolls and thereafter is held in the flutes of one of the corrugating rolls by fingers. For example, see Finger 54 in U.S. Pat. No. 3,390,040.

It is known to use vacuum in connection with one of the corrugating rolls to eliminate the fingers. Generally, fingers are objectionable in that they result in non-adhered streaks in the laminated singleface web. U.S. Pat. No. 657,100 discloses air shields designated I, I' juxtaposed to corrugating rolls for drying the web. U.S. Pat. No. 1,981,388 discloses circumferential grooves in a corrugating roll for receiving a suction tube which has holes for causing the web to adhere to the corrugating roll. U.S. Pat. No. 2,068,155 discloses two suction tubes interconnected by a groove in the corrugating roll for causing the web to adhere to the corrugating roll. British Pat. No. 2,005,595 discloses a single housing in place of the two suction tubes in the last mentioned patent and grooves in the corrugating roll for causing the web to adhere to the corrugating roll.

In addition, U.S. Pat. No. 3,947,206 teaches the utilization of longitudinal conduits connected to an external manifold to introduce suction through radial holes to the corrugated medium. It is known from U.S. Pat. No. 4,177,102 to interconnect the radial holes by a peripheral groove.

SUMMARY OF THE INVENTION

A typical single facer machine has first and second corrugating rolls for corrugating a web passing therebetween. The rolls have mating longitudinally extending flutes. In connection with such a machine, it is known to eliminate fingers and provide a means for applying suction to the second corrugating roll for retaining the corrugated web on approximately one-half of the perimeter of the second roll. Over said approximate one-half perimeter of the second corrugating roll, suction retains the corrugated web in the longitudinally extending flutes. The one-half perimeter of the second corrugating is that portion of the circumference between the nip of the corrugating rolls and the nip between the lower corrugating roll and the pressure roll adjacent the glue mechanism.

In such a single facer, the present invention is directed to the improvement wherein the second corrugating roll has a hollow core member through which a heated fluid may flow. A sleeve surrounds and is secured to the core. The longitudinally extending flutes are on the outer perimeter of the sleeve.

The perimeter of the sleeve is provided with spaced annular slots. Corresponding grooves are provided on the outer periphery of the core member. Radial channels communicate the slots with the grooves.

A means for applying suction to the second corrugating roll includes a housing enclosing a portion of the perimeter of the second corrugating roll opposite the one-half perimeter. The housing has pendant fingers, each disposed in an annular slot to confine the suction effect to the housing and the enclosed portion of the perimeter of the second corrugating roll. The suction effect is thus directed to the corrugated medium in the flutes on the one-half perimeter.

It is an object of the present invention to provide a fingerless single facer machine which enables corrugating rolls to be internally heated by passing a fluid therethrough while at the same time using suction to retain a corrugated web on a portion of the perimeter of one of the corrugating rolls. This is accomplished in a manner which provides other advantages. Thus, the corrugating roll subjected to suction has its flutes on the outer perimeter of a sleeve which may be separately heat treated and of different material than the core.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a diagramatic sectional view through a single facer.

FIG. 2 is a sectional view of the meshed corrugating rolls and juxtaposed pressure roll.

DETAILED DESCRIPTION

Figure 3:
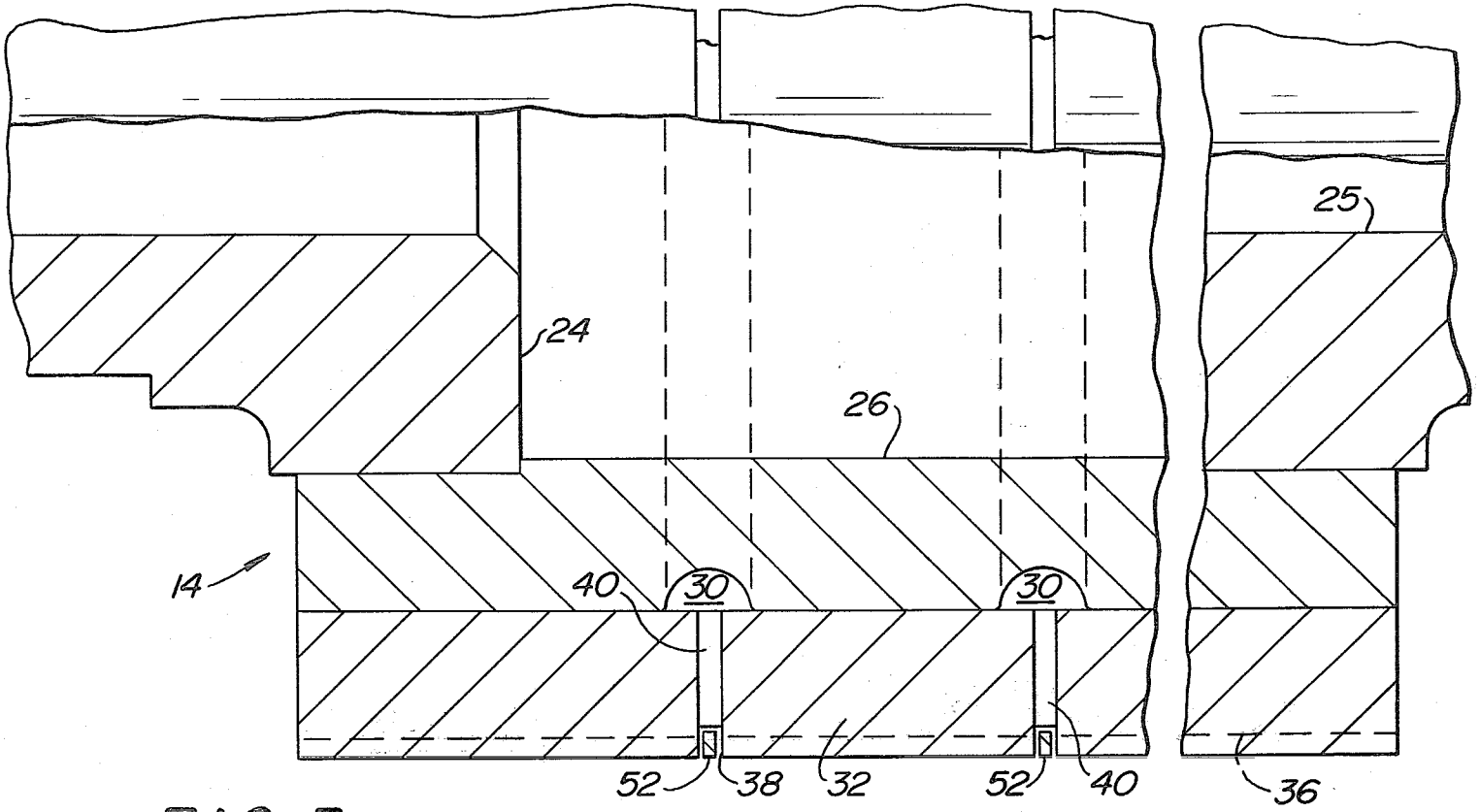
FIG. 3 is a sectional view taken along the line 3—3 but on an enlarged scale.

Referring to the drawing in detail, wherein like numerals indicate like elements, there is diagramatically illustrated in FIG. 1 a single facer designated generally as 10. The single facer 10 is conventional except for the lower corrugating roll and the suction apparatus associated therewith.

The corrugator 10 includes an upper or first corrugating roll 12, and a lower or second corrugating roll 14 which are juxtaposed in meshed engagement by way of longitudinally extending flutes. A pressure roll 16 is juxtaposed to the lower corrugating roll 14. Each of rolls 12, 14 and 16 is hollow and may be internally heated by a fluid such as steam or oil.

In the single facer machine 10, a medium 18 is corrugated by the rolls 12 and 14 and bonded to a liner 20. The laminated web is a single face web designated as 22.

Figure 5:
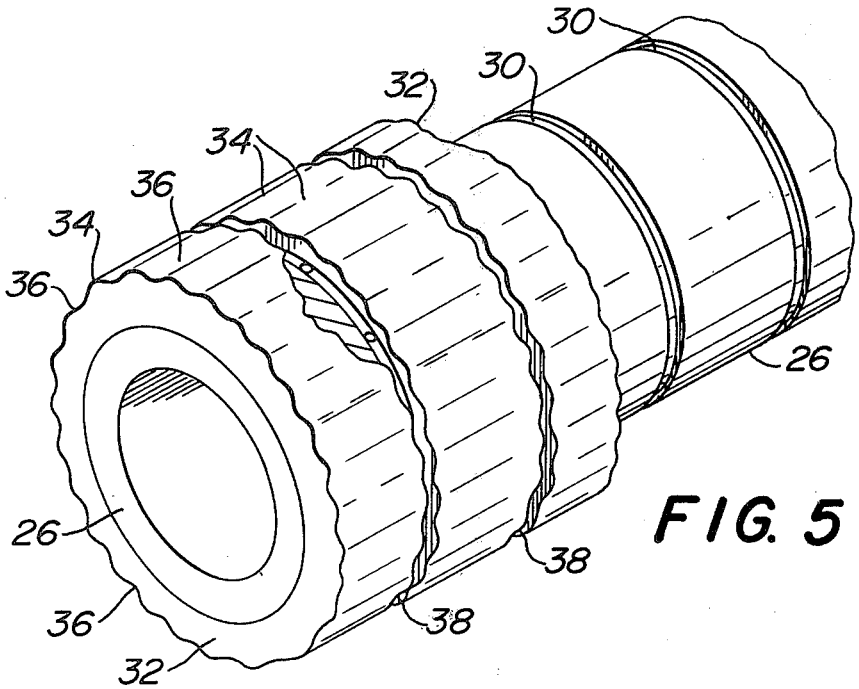
FIG. 5 is a partial perspective view of the middle corrugating roll.

Referring to FIGS. 2 and 3, the lower corrugating roll 14 includes journals 24 and 25 at its ends for supporting a hollow core 26. Core 26 may be heat shrunk onto the journals 24, 25 to thereby define a vessel through which a heated fluid may pass. Core 26 is provided with circumferentially arranged grooves 30 at spaced points therealong. See FIGS. 2 and 5. The depth of the grooves 30 are substantially identical. Similar grooves may be provided alternatively in the bore of sleeve 32.

A sleeve 32 surrounds and is heat shrunk or otherwise secured onto the outer periphery of core 26. Sleeve 32 has longitudinally extending flutes comprising crests 34 and valleys 36 which are in mating engagement with corresponding crests and valleys on the upper corrugating roll 12. The sleeve 32 has circumferential slots 38 at spaced points therealong. Each slot 38 intersects each of the valleys 36 and is deeper than such valleys 36 as shown more clearly in FIG. 3. Each of the slots 38 has a plurality of radially directed holes 40 extending from the bottom surface 54 to the inner periphery of sleeve 32. The slots 38 are aligned longitudinally with the grooves 30 so that holes 40 communicate slots 38 with grooves 30. Preferably, the diameter of holes 40 is less than the width of the slots 38. The depth of the slots 38 is greater than that of the flutes which, as is known to those skilled in the art, may be A-, B-, C- or E-flute.

Figure 4:
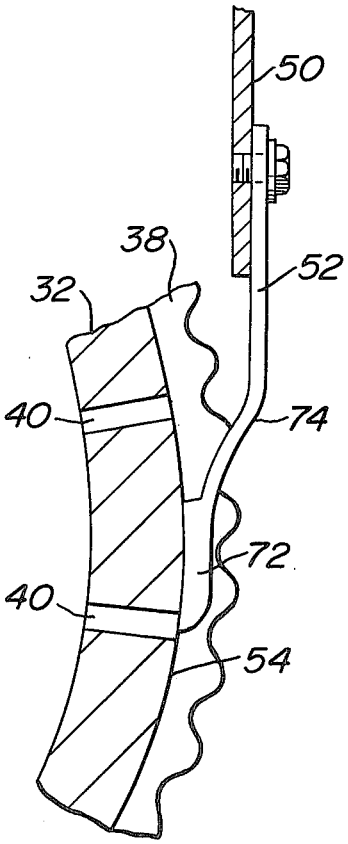
FIG. 4 is an enlarged detailed view of the stripper.

A suction housing 42 is supported by the single facer 10 adjacent approximately 180° of the perimeter of the lower corrugating roll 14. Housing 42 has suction communicated thereto by way of conduit 44 which in turns communicates with a vacuum pump 46. A suction chamber 49 is provided within the housing 42 between the sidewalls 48 and 50. Sidewall 50 supports a plurality of strippers 52. Each stripper 52 extends into one of the slots 38 on the sleeve 32. See FIG. 3. A stripper 52 is shown on an enlarged scale in FIG. 4. Stripper 52 is curved to seat against surface 54 and reflexed in the opposite direction to guide the single face web 22 out of the flutes of roll 14. The outer end of the stripper 52 is provided with a pad 72 to provide clearance between the surface 54 and the shank 74 of the stripper 52 for maximum access of the suction to the holes 40.

The suction housing 42 is also provided with sealing members 60 which extend into slots 38 opposite strippers 52 to further aid in restricting the suction to the housing chamber 49. Member 60 has a curved portion 61 which matches the curvature of the bottom surface 54 of slot 38. Member 60 is adjustably attached to wall 48 by way of a fastener disposed within an elongated slot in member 60.

In operation, suction from chamber 49 is communicated to the medium 18 while the latter is on approximately one-half of the perimeter of the lower corrugating roll 14. Such communication from chamber 49 is by way of holes 40 on one-half of the sleeve, grooves 30, and the holes 40 on the opposite half of the sleeve. The strippers 52 strip the single faced paperboard web 22 from lower corrugating roll 14.

The housing 42 is closed at its ends. The end walls as well as the sidewalls 48, 50 are adjacent to but slightly spaced from the periphery of the lower corrugating roll 14. The suction effect on the medium 18 eliminates the necessity for fingers which have been conventional heretofore. Adhesive is applied to the crests of the medium 18 while it is on the lower corrugating roll 14 by the applicator roll 66. Roll 66 may be provided with a doctor roll 68.

Each embodiment of the present invention eliminates the necessity for fingers. By utilizing an outer sleeve for the portion of the roll having the corrugations thereon, material specification of the roll as well as heat treating are simplified. Options on choices of materials are provided so that the optimum material for core 26 may be chosen separately from the optimum material for the sleeve 32. At the same time, there is provided a lower corrugating roll which may be internally heated by liquid or gas.

The present invention may be embodied in other specific forms without departing from the spirit or essential attributes thereof and, accordingly, reference should be made to the appended claims, rather than to the foregoing specification, as indicating the scope of the invention.

I claim:

1. In a single facer machine having first and second corrugating rolls provided with longitudinally extending meshing flutes for corrugating a web of material passing therebetween, and suction means for retaining the corrugated web on approximately one-half the perimeter of said second roll, the improvement comprising:

(a) said second roll having a central hollow core for receiving a heated fluid, the outer periphery of said hollow core having a plurality of circumferential grooves at spaced locations therealong;

(b) a sleeve surrounding and secured to said hollow core, said sleeve having a plurality of spaced annular slots in the perimeter thereof, the longitudinally extending flutes of the second roll being on the perimeter of said sleeve, said sleeve having a plurality of passages extending radially from the inner periphery of each of said annular slots to the interior of said sleeve;

(c) means for applying suction to said second corrugating roll by way of said grooves and slots to hold the corrugated web on a portion thereof, including a housing disposed diametrically opposite said one-half perimeter, said housing having strippers, each stripper being disposed in one of said slots for stripping the corrugated web from said flutes in said second corrugating roll.

2. In a machine in accordance with claim 1 wherein the annular slots in the perimeter of said sleeve are deeper than the depth of said flutes.

3. In a machine in accordance with claim 1 wherein each of the annular slots in said sleeve is radially coincident with one of the circumferential grooves in said core and said passages are holes communicating each of the slots with one of the grooves.

4. In a machine in accordance with claim 1 wherein said housing includes a plurality of sealing members, each member being disposed in one of said annular slots.

5. In a single facer machine having first and second corrugating rolls provided with longitudinally extending meshing flutes for corrugating a web of material passing therebetween, and suction means for retaining the corrugated web on approximately one-half the perimeter of said second roll, the improvement comprising:

(a) said second corrugating roll having a central hollow core for receiving a heated fluid, (b) a sleeve surrounding and secured to said hollow core, said sleeve having a plurality of spaced annular slots in the perimeter thereof, a plurality of circumferential grooves at the interface of said core and sleeve, each groove being radially coincident with an annular slot, each annular slot communicating with a mating circumferential groove through a plurality of channels extending radially from the inner periphery of the slots to its mating groove; and, (c) means for applying suction to said second corrugating roll to hold the corrugated web thereon and including a housing diametrically opposite said one half perimeter, said housing having strippers, each disposed in one of said slots for stripping the corrugated web from said flutes in said second corrugating roll.

6. In a machine in accordance with claim 5 wherein the annular slots in the perimeter of said sleeve are deeper than the depth of said flutes.

7. In a machine in accordance with claim 5 wherein each channel is a hole and the diameter of each hole is less than the width of the annular slots.

8. In a machine in accordance with claim 5 wherein said housing includes a plurality of sealing fingers, each finger being disposed in an annular slot.

9. In a machine in accordance with claim 5 wherein said slots are on the outer periphery of said sleeve and said grooves are on the outer periphery of said core.

10. In a single facer machine having first and second corrugating rolls provided with longitudinally extending meshing flutes for corrugating a web of material passing therebetween, and suction means for retaining the corrugated web on approximately one-half the perimeter of said second roll, the improvement comprising:

(a) said second corrugating roll having a central hollow core for receiving a heated fluid, (b) a sleeve surrounding and secured to said hollow core, a plurality of spaced circumferential grooves at the interface of said core and sleeve, a plurality of circumferentially spaced channels extending radially from the outer periphery of the sleeve to one of said grooves at spaced locations along the length of said second corrugating roll; and, (c) said suction means including a housing diametrically opposite said one-half perimeter, whereby suction is communicated from said housing to the channels on said one-half perimeter by said grooves and the remaining channels.

11. In a machine in accordance with claim 10 wherein said grooves are on the outer periphery of said core.

* * * * *